US006811054B1

(12) United States Patent
Moest et al.

(10) Patent No.: US 6,811,054 B1
(45) Date of Patent: Nov. 2, 2004

(54) DOSING SPOON FOR MICRO-TABLETS

(75) Inventors: Thomas Moest, Moorrege (DE); Ludwig Matz, Tornesch (DE)

(73) Assignee: Nordmark Arzneimittel GmbH & Co. KG, Uetersen (DE)

( * ) Notice: Subject to any disclaimer, the term of this patent is extended or adjusted under 35 U.S.C. 154(b) by 0 days.

(21) Appl. No.: 10/009,061

(22) PCT Filed: May 3, 2000

(86) PCT No.: PCT/EP00/03963

§ 371 (c)(1),
(2), (4) Date: Apr. 11, 2002

(87) PCT Pub. No.: WO00/67695

PCT Pub. Date: Nov. 16, 2000

(30) Foreign Application Priority Data

May 6, 1999 (DE) ..... 299 07 996

(51) Int. Cl.[7] ..... G07F 11/56

(52) U.S. Cl. ..... 221/25; 221/255

(58) Field of Search ..... 221/7, 13, 25, 221/26, 27, 30, 92, 191, 255, 256

(56) References Cited

U.S. PATENT DOCUMENTS 5,785,194 A * 7/1998 Ogden ..... 215/302

FOREIGN PATENT DOCUMENTS

| | | |
|---|---|---|
| CH | 242049 | 4/1996 |
| NL | 66782 | 10/1947 |

* cited by examiner

*Primary Examiner*—Kenneth Noland
(74) *Attorney, Agent, or Firm*—Friedrich Kueffner

(57) ABSTRACT

A dosing spoon for microtablets is described for which the lower part (1) of the spoon consists of an even polygone which possesses a border (2) on all sides with exception of one side and whereby the polygone has a number of individual recesses (3) which are formed in such a way that an individual microtablet fits in each individual recess.

8 Claims, 1 Drawing Sheet

DOSING SPOON FOR MICRO-TABLETS

Figure 1:
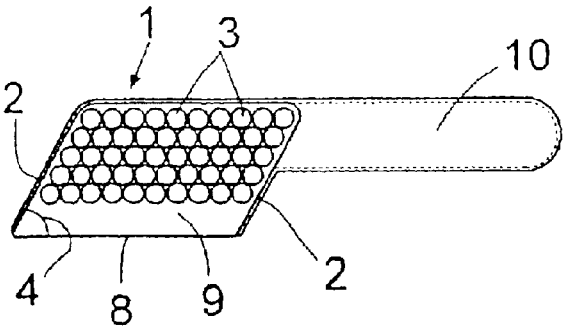

This invention relates to a dosing spoon for microtablets according to the preamble of claim 1.

The dosing of Multi Unit Dose (MUD) forms is usually performed by capsules. In MUD formulations, the effective component is divided out to many individual drug forms such as, for example, pellets or microtablets.

This has the advantage that, after the drug has been taken, the active substance is uniformly distributed over the whole gastric and intestinal volume and is uniformly released in low local concentrations. The release of active substance can thus be purposefully controlled by retardation or gastric juice resistent formulation. The disadvantage of the traditional MUD forms is the difficult and complicated individual dosing for the patient.

The traditional filling of MUD formulations in hard gelatine capsules does not solve this problem. On the one hand, fixed dose quantities of the active substance are predetermined and on the other hand some patients cannot swallow capsules or only with much difficulty.

By opening the capsules and taking the content, the latter problem can be eluded, however this is a very expensive way to dose, since capsules and the filling and closing of the capsules are relatively expensive at production.

A safe individual dosing is practically not possible by removing and dividing the content of the capsule since the contents of one or of several capsules must be divided up to the required quantity. However, a patient cannot do this or only with much effort.

A formulation of the drug form as a heap, i.e. as a filling in a container, and the taking as a dose with for example a spoon or a measuring spoon is quite unprecise, in particular for smaller volumes, such as for example those which correspond to usual capsule contents and can be reproduced only with big fluctuations. For usual pellet formulations, there comes as an additional difficulty the fact that, due to the irregularity of the grain sizes due to the production, the fluctuation width is still increased in case of a taking of volume and and thus the requirements of the European pharmacopeia of a homogeneity of dosage such as those for tablets cannot be complied with. Microtablets which have a diameter range of 1,0 to 3,0 mm can be produced relatively simply with an uniform size and a constant active substance content. A very precise individual division of the dose could basically be carried out by counting the microtablets, however this cannot be expected from the patient, in particular when he has to count bigger quantities of microtablets.

By the NL 66782 C, we know a shovel-type dosing spoon for tablets for which a lower part is provided with a certain number of holes for receiving the tablets which are closed on the lower side by means of a base plate connected with the lower part. A handle is fixed on the lower part and on the base plate. The lower part is provided on all sides with exception of one side with a border, whereby the borderless side has a shovel-type opening and is opposed to the handle. Furthermore, a transparent covering plate is fixedly attached on the border of the lower part and at a distance thereof. The transparent covering plate is provided with an upper separating bead running tranversely to the direction of the handle which projects upwards over the covering plate and with a lower separating bead which is placed on the lower side of the covering plate, whereby both separating beads and the holes are placed in the lower part in such a way that the holes are completely between the handle and the separating beads. When putting the dosing spoon into a bulk of tablets, the upper separating bead avoids that tablets come onto the covering plate which is above the holes of the lower part. Both ends of the border taper to the tip, whereby a transparent guiding lamina is fixed to one of these ends. When the dosing spoon sufficiently filled from the bulk with simultaneously performed shaking movements in direction of the surface of the lower part with the holes is pulled into a position inclined ahead, each hole is filled with a tablet and the excess tablets glide from the lower part back into the bulk. In order to fill the thus isolated determined quantity of tablets into a packing, the dosing spoon is turned about half a turn so that the pieces are on the covering plate, whereafter the dosing spoon is turned back about a quarter turn so that the tablets glide along the smooth surface of the covering plate into the part with the border in which the end together with the guiding lamina form a duct along which the pieces can be brought into the packing, for example a box. For such a manipulation of the dosing spoon, the covering plate placed above the lower part provided with the holes is indispensable; a closed shovel is formed more or less which serves exclusively for counting big volume lumpy goods from big packing containers and for filling the quantities counted therewith in the small packing container for what purpose it is necessary to take a bigger quantity out of the container and to give the excess quantity back into the container, before the counted quantity can be given into a small container. A complete emptying of the shovel-type container is not possible with such a configuration of the dosing spoon.

A device has now been found with which a precise dosing can be simply achieved by taking out an exact number of microtablets from a storage container.

The object of the invention is a dosing spoon for microtablets with the characteristics characterized in claim 1.

Accordingly, the dosing spoon consists in that the individual recesses for receiving the microtablets in the lower part of the open-top configured dosing spoon are made of cylindrical bore holes which are configured in the lower part in obliquely offset placed rows and that the borderless side of the lower part is running parallel to the longitudinal axis of the spoon handle which runs in longitudinal direction to the side of the lower part which shows the border which is opposite the borderless side of the lower part.

Thus, the object of the invention is a dosing spoon for microtablets for which the lower part of the spoon is made of an even polygone which possesses a border 2 on all sides with exception of one side and whereby the polygone has a number of individual recesses 3 which are formed in such a way that an individual microtablet fits in each individual recess.

The polygone is generally a square in which the two sides which are opposite have the same length (parallelogram). The small angle 4 of the parallelogramm is between 45 and 9°. A long side 5 of the parallelogramm as well as both smaller sides 6, 7 are provided with a border 2 which somewhat stands over the polygone vertically, i.e. up to 5 mm.

Small cylindrical bore holes 3 are countersunk into the polygone of the dosing spoon, whereby their diameter and depth is dimensioned in such a manner that a microtablet easily fits in each opening. The diameter of the bore holes is between 1,5 and 4,0 mm. The same is valid for the depth of the bore holes. In special cases, the diameter and depth should be bigger by 0,2 mm than the biggest diagonal of the microtablet for which the dosing spoon should be used. The cylindrical bore holes are normally placed in such a way that as many holes as possible are placed on 1 $cm^2$ of the polygone. The total number of the holes corresponds to the quantity of microtablets to be taken. This number is generally from 5 to 100, preferably from 10 to 60.

On the borderless side of the polygone, there is still appropriately a zone without openings which normally has a width up to 1 cm. This zone facilitates the filling of the holes with microtablets, in particular from a container which still contains only small quantities of microtablets.

The spoon handle 10 is preferably provided in the prolongation of the side on the longer border.

Figure 2:
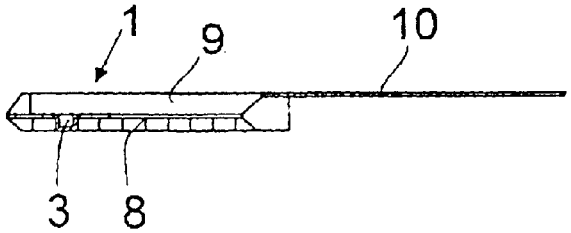
Figure 3:
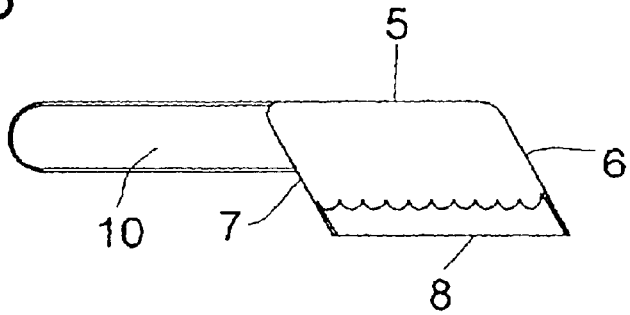
Figure 4:
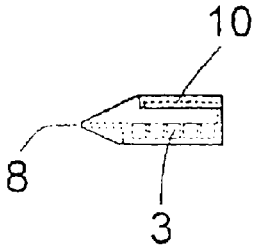

The attached drawings show a preferred embodiment of the invention. FIG. 1 is a topview of the dosing spoon from above and FIG. 3 shows the spoon from below. FIG. 2 is a cross section through the spoon in the longitudinal direction and the transverse direction.

What is claimed is:

1. A dosing spoon for microtablets with a spoon handle (10) and with a lower part (1) which consists of an even polygone which possesses a border (2) on all sides with exception of one side and whereby the lower part (1) has several rows of individual recesses which are formed in such a way that an individual microtablet fits in each individual recess, wherein the individual recesses for receiving the microtablets in the lower part (1) of the open-top configured dosing spoon are made of cylindrical bore holes (3) which are configured in the lower part (1) in obliquely offset placed rows and that the borderless side (8) of the lower part (1) is running parallel to the longitudinal axis of the spoon handle (10) which runs in longitudinal direction to the side of the lower part (1) which shows the border which is opposite the borderless side (8) of the lower part (1).

2. A dosing spoon according to claim 1, wherein the polygone of the lower part (1) is made of a square in form of a parallelogram in which the opposing sides have the same lengths, whereby preferably the small angle (4) between two sides of the parallelogram is between 45° and 90° and whereby one long side (5) of the parallelogram as well as the two shorter sides (6, 7) are provided with a border (2).

3. A dosing spoon according to claim 2, wherein the border (2) of the two shorter sides (6, 7) of the parallelogram slightly projects over the polygone, for example up to 5 mm vertically.

4. A dosing spoon according to claim 1, wherein the diameter and the depth of the cylindrical bore hole (3) are biqqer than the biggest diagonal of a microtablet.

5. A dosing spoon according to claim 1, wherein the diameter and the depth of the cylindrical bore hole (3) are between 1,5 mm and 4,0 mm.

6. A dosing spoon according to claim 1, wherein the correspondence of the cylindrical bore holes (3) in the lower part (1) is close together.

7. A dosing spoon according to claim 1, wherein the total number of the cylindrical bore holes (3) in the lower part (1) corresponds to the quantity of the microtablets to be received, whereby the number of the cylindrical bore holes (3) is from 5 to 100, preferably from 10 to 60.

8. A dosing spoon according to claim 1, wherein on the borderless side (8) of the polygone a zone without bore holes, which has preferably a width up to 1 cm, is configured for facilitating the filling of the cylindrical bore holes (3) with microcapsules.

* * * * *